US005303884A

United States Patent [19]

Rivas

[11] Patent Number: 5,303,884

[45] Date of Patent: Apr. 19, 1994

[54] INTERCHANGEABLE INSERT FOR RAILROAD SWITCHES

[76] Inventor: Arturo A. O. Rivas, Manuel Ma De Llano, No. 1104-D Ote, Monterrey, N.L., Mexico

[21] Appl. No.: 499

[22] Filed: Jan. 5, 1993

Related U.S. Application Data

[63] Continuation of Ser. No. 705,184, May 24, 1991, abandoned.

[30] Foreign Application Priority Data

Jun. 6, 1990 [MX] Mexico ..... 21024

[51] Int. Cl.[5] ..... E01B 7/02

[52] U.S. Cl. ..... 246/435 R; 246/437

[58] Field of Search ..... 246/385, 415 R, 435 R, 246/437, 438, 442

[56] References Cited

U.S. PATENT DOCUMENTS

| | | | |
|---|---|---|---|
| 702,113 | 6/1902 | Palmer | 246/437 X |
| 951,205 | 3/1910 | Strong | 246/437 |
| 1,005,209 | 10/1911 | Henderson | 246/437 |
| 1,033,400 | 7/1912 | Hoffmann | 246/437 |
| 1,334,466 | 3/1920 | Mitchell | 246/437 |
| 1,811,620 | 6/1931 | Einstein et al. | 246/437 |
| 1,829,439 | 10/1931 | Enstrom | 246/437 |

FOREIGN PATENT DOCUMENTS

| | | | |
|---|---|---|---|
| 1077686 | 3/1960 | Fed. Rep. of Germany | 246/437 |

OTHER PUBLICATIONS

American Railway Engineering Association, "Manganese Steel Points for Split Switches" Trackwork Plan No. 220.52, date unknown, but before 1990.

*Primary Examiner*—Michael S. Huppert
*Assistant Examiner*—Scott L. Lowe
*Attorney, Agent, or Firm*—Pravel, Hewitt, Kimball & Krieger

[57] ABSTRACT

The invention relates to a manganese steel insert to a railroad track switch point of the type designed to have a planar coupling system within both the web of the rail and the switch point of the insert, instead of the conventional curved coupling surface in use at the present. This is achieved by means of an attachment of the same material as the insert (or other steel) on the insert contact surfaces, thus achieving precision plane surfaces during the machining phase.

3 Claims, 3 Drawing Sheets

INTERCHANGEABLE INSERT FOR RAILROAD SWITCHES

CROSS-REFERENCE TO RELATED APPLICATIONS

The present application is a continuation of my prior co-pending U.S. Pat. application Ser. No. 705,184 filed May 24, 1991, now abandoned.

BACKGROUND OF THE INVENTION

1. Field of the Invention

This invention relates to an improved insert for switch points in railroad tracks. More particularly, the improvement of the present invention relates to changing the contact surfaces of both the point insert and the switch-point rail such that, instead of the conventional, curved contact surface, flat surfaces are provided.

2. Description of the Prior Art

In order to divert railroad rolling stock from one set of tracks to a separate set of tracks, switches must be provided. A switch set includes a pair of switch points, a set of switch slide plates, main and connecting rods, and a manually or power-actuated switch stand. To be operated within the U.S., these switches must comply with the specifications set out in the American Railway Engineering Association Portfolio Trackwork Plans, Plan No. 220-52. In these switches, a point insert abuts a switch-point rail along the web of the rail. Since the web of the rail is by long established design principles a curved surface, the mating surface of the point insert is also curved such that a curved contact surface is produced between them. Due to the curved surfaces, conventional point inserts and switch-point rails must be custom fitted to each other, thereby increasing the overall cost of switches since when one part wears out, usually the insert, the whole assembly must be replaced.

There has long been a need for an improved point for split switches which would provide more precise coupling between the point insert and the switch-point rail while providing for extended life of the overall switch by implementation of design features on both the point insert and the switch-point rail which would render each part readily exchangeable once the original part became worn.

SUMMARY OF THE INVENTION

The present invention relates to improved points for split switches in railroad tracks. More particularly, the improvement of the present invention relates to improving the coupling surfaces on both the point insert and the switch-point rail such that instead of the conventional curved coupling surface, flat coupling surfaces are provided, thereby providing for improved coupling as well as extending the life of the overall switch.

This invention relates to an improved manganese steel insert for switch points of railroad tracks made of one solid piece which has an attachment of material onto a surface planar with the radial tangent of the web of the rail (before machining). The planar surface extends from its upper part up to the stop through its lower part below the bolt holes.

The object of the present invention is to provide a new insert of manganese steel for the switch points which is functional and exchangeable in normal use.

It is, therefore, an object of the present invention to provide an improved coupling surface between the point insert and the switch-point rail with the added benefit that by the nature of the coupling surface, the point insert becomes exchangeable.

Among the advantages of this insert are that it is more accurate, more durable; more economical, because the insert is interchangeable the switch point lasts up to three times longer, it being possible to overhaul the switch points fabricated in the traditional way as new up until the service life limit of the rail.

The purpose of this improved insert is to offer the best condition in the assembly of the insert and the switch point rail at lower cost.

BRIEF DESCRIPTION OF THE DRAWINGS

The characteristic details of the present invention are clearly shown in the following description and accompany figures, which illustrate this and provide points of reference to indicate the same parts in the figures shown.

DESCRIPTION OF THE PREFERRED EMBODIMENTS

Figure 1A:
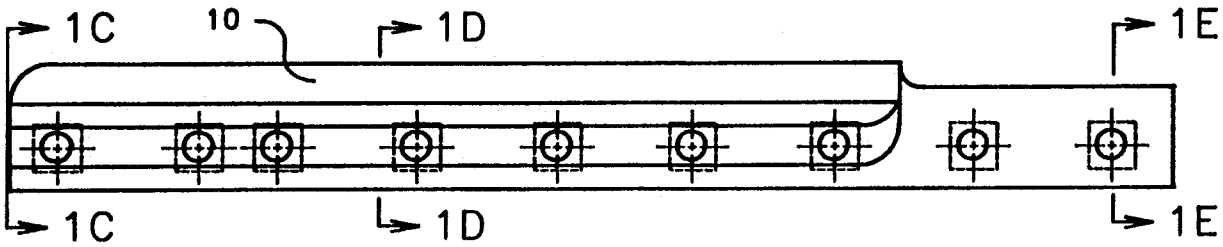
FIGS. 1*a* and 1*b* are side and plan views, respectively, of an insert, before being machined.
Figure 1B:
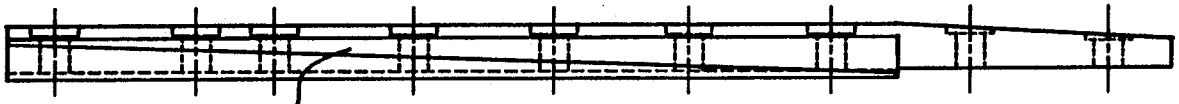
Figure 1D:
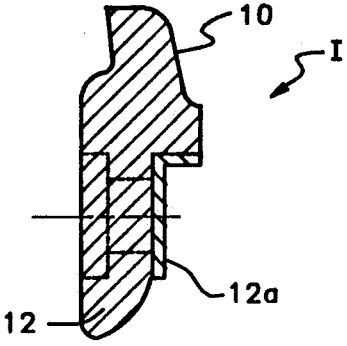
FIGS. 1*c*, 1*d*, and 1*e* are cross-sectional views taken along the lines 1*c*—1*c*, 1*d*—1*d*, and 1*e*—1*e*, respectively, of FIG. 1*a*.
Figure 1C:
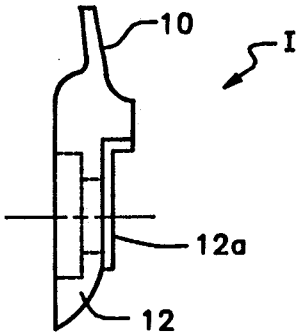
Figure 1E:
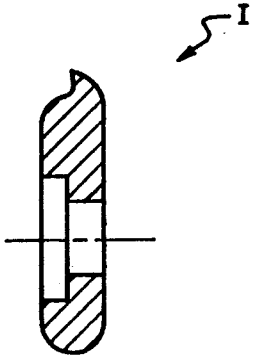
Figure 2A:
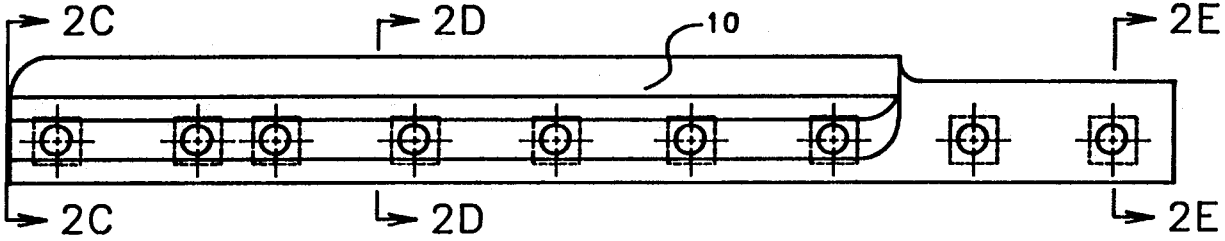
FIGS. 2*a* and 2*b* are side and plan views, respectively, of the insert of FIGS. 1*a* through 1*e* after being machined.
Figure 2B:
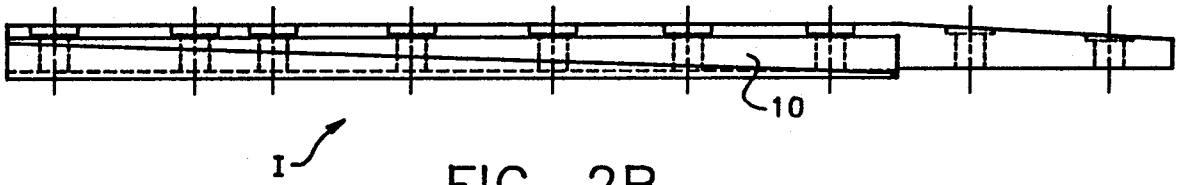
Figure 2C:
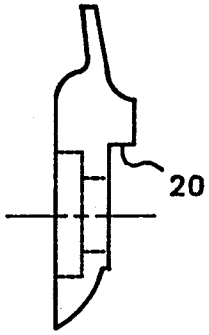
FIGS. 2*c*, 2*d*, and 2*e* are cross-sectional views taken along the lines 2*c*—2*c*, 2*d*—2*d*, and 2*e*—2*e*, respectively, of FIG. 2*a*.
Figure 2D:
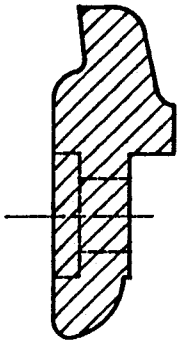
Figure 2E:
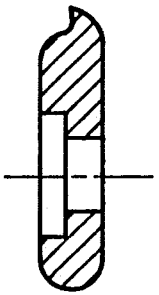

In accordance with the drawings the insert I of FIGS. 1*a* through 1*e* and 2*a* through 2*e* has two very important components. A first one is the upper part 10 where the train wheels roll and a lower part 12 which has an aggregate of material 12*a* that has a planar surface which is tangent to the conventional radius of the web of the rail. The planar surface extends over the upper part unto the stop or buffer of the rail and over the lower part to the height of the bolt holes. The shaded parts 12*a* in the cross-sectional views of the FIGS. 1*c* and 1*d* represent the added material which is present in the original foundry piece in the insert according to the present invention. This aggregate 12*a* is the fundamental part of the present invention.

Figure 3A:
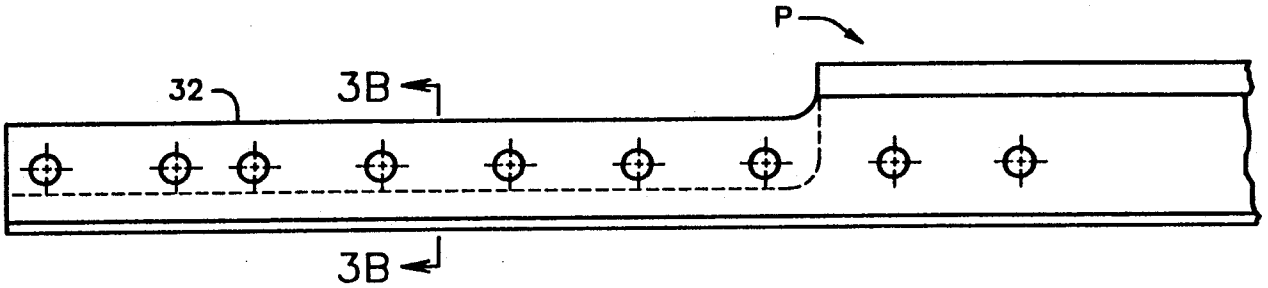
FIG. 3*a* is a side lateral view of a switch point rail after being fabricated.

After the piece has been cast or forged and been heat treated, the insert I is subject to various machining operations to form the resulting machined insert shown in FIGS. 2*a* through 2*e*. The most important is to make a right angle 20 which forms a contact face with the seat of connection with the switch point P of FIG. 3*a*. Once this angle 20 of ninety degrees is formed, it serves as the reference to all the finishing machining measures of the insert I.

The next step begins taking as reference point for machining the base 30 of the rail. This determines the height of the plane 32 where the mating flat surface of insert seat 20 sits. The plane 32 is the dimensional reference to all the rest of the measurements of the part of the rail switch point P of FIG. 3*a* that connects to the insert of FIG. 2*a*.

After this, a lateral plane 34 is made by a machining process, forming a 90° angle with plane 32. The lateral plane 34 serves as the seat of the insert of FIG. 2*a* and tangent to the conventional radius of the web of the rail switch point, extending this plane in the lower part below the bolt holes. This machining step jointly with the one made to the insert is another feature of the present invention.

Figure 3B:
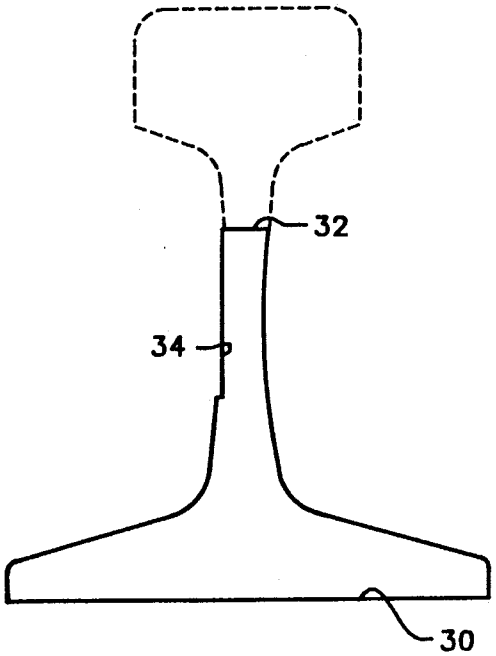
FIG. 3*b* is a cross-sectional view taken along the lines 3*b*—3*b* of FIG. 3*a*.

An essential feature of the present invention rests in the vertical machining of the web 34 of the rail switch point of FIG. 3*b* to eliminate the original curvature of the conventional rail web. This curved surface causes problems during assembly of the traditional steel manganese joint because of the difficulty in the field of aligning curved surfaces.

Figure 4:
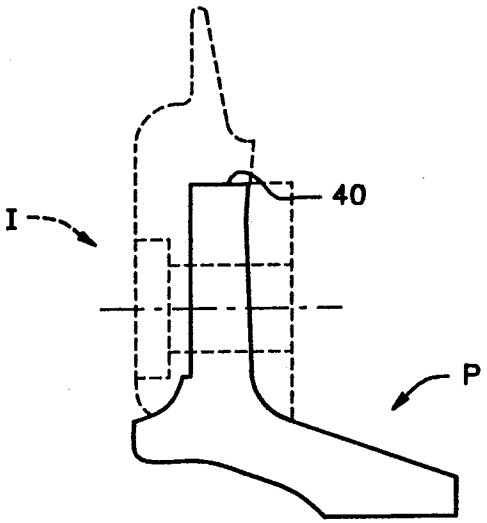
FIG. 4 is a front view of the assembled insert of FIG. 2*a* and the rail switch point of FIG. 3*a*.

The advantages of this improvement of the present invention to the prior art switch inserts are: perfect assembly between the insert I and the switch point rail 40 (FIG. 4), longer durability—since the insert is exchangeable, the switch point rail can last three times as long, and is more economical.

An additional benefit of the invention is that when existing conventional point inserts wear out, they may be replaced with the improved point insert of the invention by machining the existing, conventional switch-point rail to provide the features described herein for the improved switch-point rail of the invention.

The improved point inserts of the present invention are constructed in accordance with the specifications and guidelines set forth in the American Railway Engineering Association Trackwork Plans and are, therefore, preferably constructed of manganese steel. Similarly, the improved switch-point rail of the invention is constructed in accordance with the specifications and guidelines as set forth in the above referenced Trackwork Plans.

From this description of preferred embodiments, those skilled in the art may find many variations and adaptations thereof, and all such variations and adaptations, falling within the scope and spirit of the invention, are intended to be covered by the claims hereafter.

I claim:

1. A method of forming an improved split switch for railroad tracks, the split switch being the combination of a switch point rail and an insert, the method comprising the steps of:

(a) forming on the switch point rail a flat upper portion being a specified height from a base portion of the switch point rail;

(b) machining a curved web portion of the switch point rail to a flat surface perpendicular to said flat upper portion of the switch point rail;

(c) forming a flat planar surface on the insert, said flat planar surface being tangent to the conventional radius of the curved web portion of the switch point rail and mating with said machined flat surface of the switch point rail;

(d) machining a right angle contact face on the insert at a right angle to said flat planar surface on the insert; and (e) assembling the formed and machined insert and the formed and machined switch point rail together to form the split switch by securing in abutting engagement the flat upper portion of the switch point rail to the right angle contact face of the insert, and the flat surface of the switch point rail to the flat planar surface of the insert.

2. The method of claim 1, wherein the forming of the planar surface on the insert is accomplished by casting.

3. The method of claim 1, wherein the forming of the planar surface on the insert is accomplished by forging.

* * * * *

UNITED STATES PATENT AND TRADEMARK OFFICE

CERTIFICATE OF CORRECTION

PATENT NO. : 5,303,884

DATED : APRIL 19, 1994

INVENTOR(S) : ARTURO A. ORTIZ-RIVAS

It is certified that error appears in the above-identified patent and that said Letters Patent is hereby corrected as shown below:

ON THE TITLE PAGE, BLOCK 76, PLEASE CHANGE THE INVENTOR'S NAME TO READ: ARTURO A. ORTIZ-RIVAS.

Signed and Sealed this

Second Day of August, 1994

*Attest:*

*Attesting Officer*

Bruce Lehman

BRUCE LEHMAN

*Commissioner of Patents and Trademarks*